US012624425B2

(12) United States Patent
Kimura et al.

(10) Patent No.: US 12,624,425 B2
(45) Date of Patent: May 12, 2026

(54) ALLOY MATERIAL, ALLOY PRODUCT FORMED OF ALLOY MATERIAL, AND MECHANICAL DEVICE INCLUDING ALLOY PRODUCT

(71) Applicant: Proterial, Ltd., Tokyo (JP)

(72) Inventors: Tatsuya Kimura, Tokyo (JP); Hiroshi Shiratori, Tokyo (JP); Kazuya Shinagawa, Tokyo (JP); Kosuke Kuwabara, Tokyo (JP); Yuzo Daigo, Tokyo (JP)

(73) Assignee: Proterial, Ltd., Tokyo (JP)

( * ) Notice: Subject to any disclaimer, the term of this patent is extended or adjusted under 35 U.S.C. 154(b) by 418 days.

(21) Appl. No.: 18/028,673

(22) PCT Filed: Sep. 29, 2021

(86) PCT No.: PCT/JP2021/035816
§ 371 (c)(1),
(2) Date: Mar. 27, 2023

(87) PCT Pub. No.: WO2022/071378
PCT Pub. Date: Apr. 7, 2022

(65) Prior Publication Data

US 2023/0332278 A1 Oct. 19, 2023

(30) Foreign Application Priority Data

Sep. 29, 2020 (JP) ..... 2020-163540

(51) Int. Cl.
*C22C 30/00* (2006.01)

(52) U.S. Cl.
CPC ..... *C22C 30/00* (2013.01)

(58) Field of Classification Search
CPC ..... C22C 30/00
See application file for complete search history.

(56) References Cited

U.S. PATENT DOCUMENTS 5,283,032 A 2/1994 Wanner et al.
2008/0031769 A1* 2/2008 Yeh ..... C22C 19/07 420/580

(Continued)

FOREIGN PATENT DOCUMENTS

JP 56-96712 A 8/1981
JP 6-500361 A 1/1994

(Continued)

OTHER PUBLICATIONS

Murray et al., "Preparation and Characterization of Pure Metals," ASM Handbook, vol. 2: Properties and Selection: Nonferrous Alloys and Special-Purpose Materials ASM Handbook Committee, p. 1093-1097, 1990.*

(Continued)

*Primary Examiner* — Christopher S Kessler
(74) *Attorney, Agent, or Firm* — Crowell & Moring LLP

(57) ABSTRACT

Provided is an alloy material in which coarse growth or aggregation and precipitation of an undesired intermetallic compound phase can be suppressed, an alloy product formed of the alloy material, and a mechanical device including the alloy product. The alloy material according to the present invention includes: 5 at % or more and 40 at % or less of each of Co, Cr, Fe, and Ni; more than 0 at % and 8 at % or less of Mo; 1 at % or more and less than 8 at % of Ti; more than 0 at % and 4 at % or less of at least one kind of Ta or Nb; and a remainder consisting of unavoidable impurities, in which a total content of Ti and the at least one kind of Ta or Nb is 3 at % or more and 8 at % or less. In the alloy product formed of the alloy material, a total occupancy of η phase and Laves phase precipitates having a size of 1 μm or more is suppressed to be 5 area % or less.

7 Claims, 5 Drawing Sheets

(56) References Cited

U.S. PATENT DOCUMENTS

| | | | |
|---|---|---|---|
| 2008/0066831 | A1 | 3/2008 | Srivastava |
| 2019/0047049 | A1 | 2/2019 | Fujieda et al. |
| 2020/0158123 | A1 | 5/2020 | Chen et al. |
| 2020/0290118 | A1 | 9/2020 | Chen et al. |

FOREIGN PATENT DOCUMENTS

| | | | |
|---|---|---|---|
| JP | 2008-69455 | A | 3/2008 |
| WO | WO 2017/138191 | A1 | 8/2017 |
| WO | WO 2019/088157 | A1 | 5/2019 |
| WO | WO 2019/088158 | A1 | 5/2019 |

OTHER PUBLICATIONS

International Search Report (PCT/ISA/210) issued in PCT Application No. PCT/JP2021/035816 dated Dec. 7, 2021 with English translation (five (5) pages).
Japanese-language Written Opinion (PCT/ISA/237) issued in PCT Application No. PCT/JP2021/035816 dated Dec. 7, 2021 (four (4) pages).
Extended European Search Report issued in European Application No. 21875678.1 dated Mar. 4, 2025 (7 pages).

* cited by examiner

[FIG. 1]
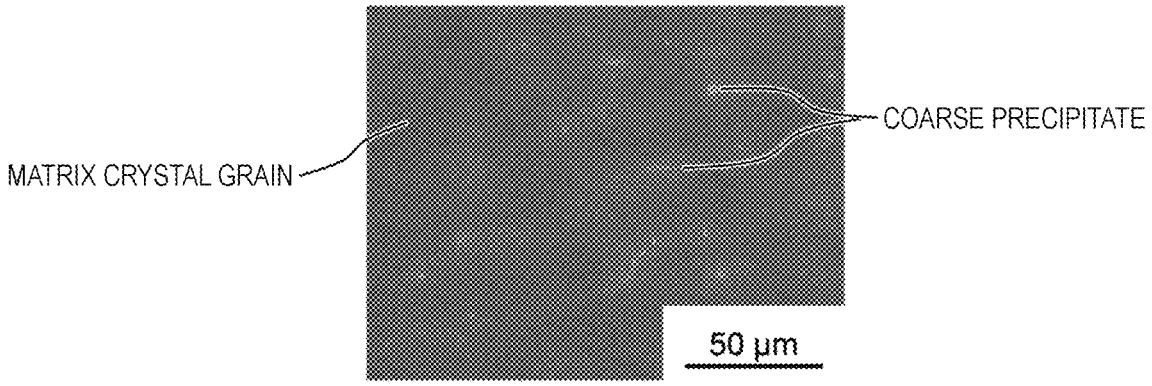
[FIG. 2]
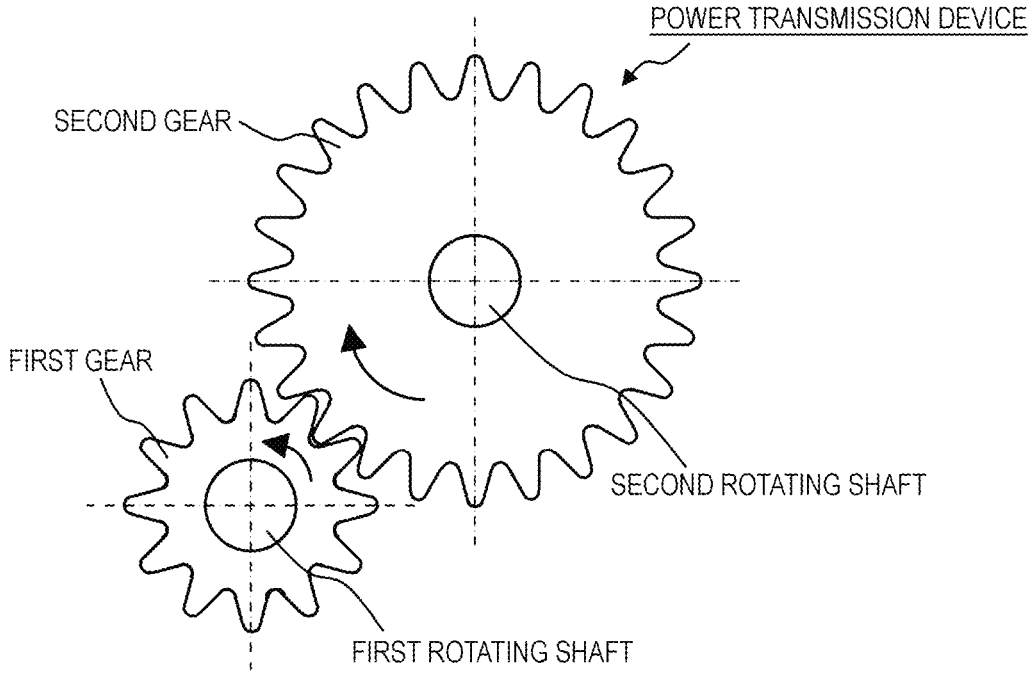

[FIG. 3]
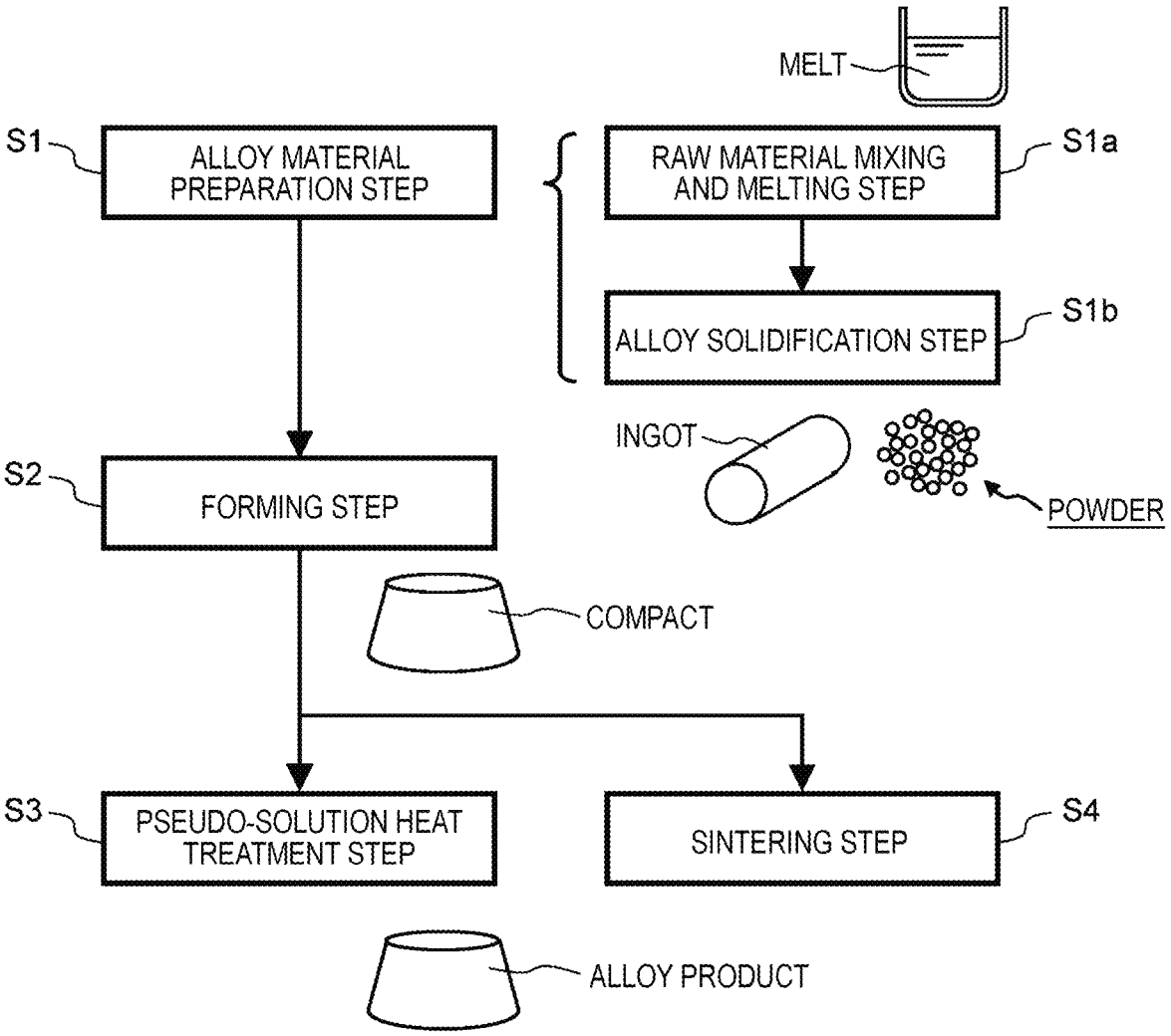
[FIG. 4A]
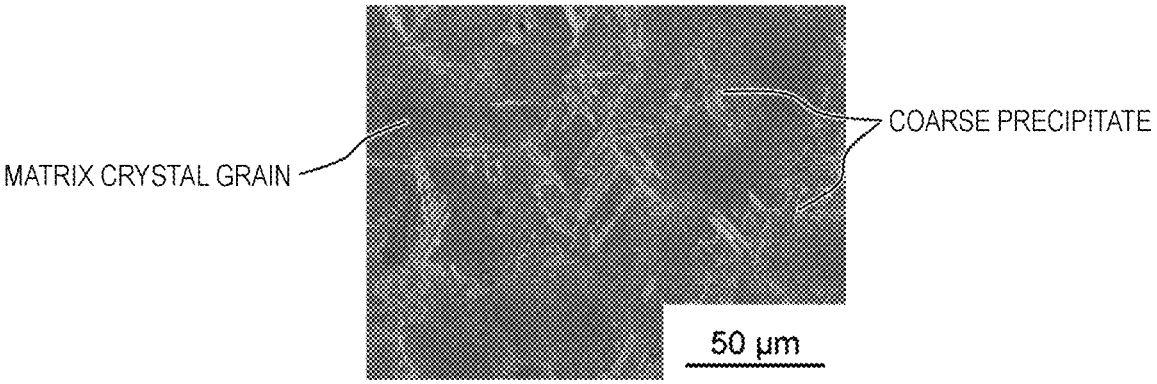

[FIG. 4B]
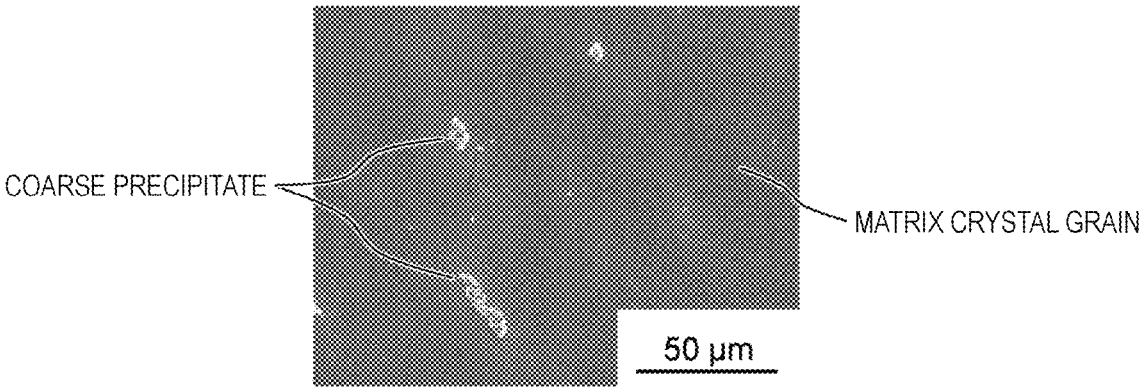
[FIG. 5]
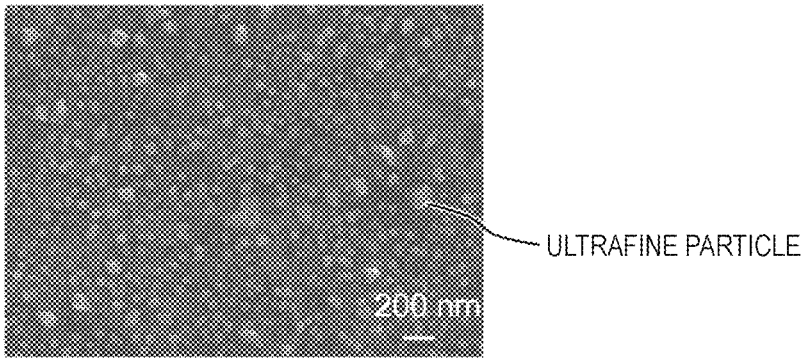
[FIG. 6A]
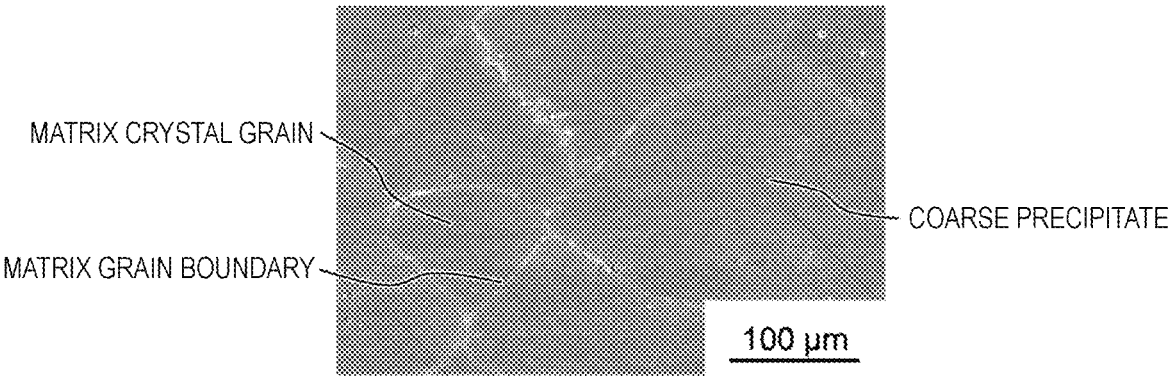

[FIG. 6B]
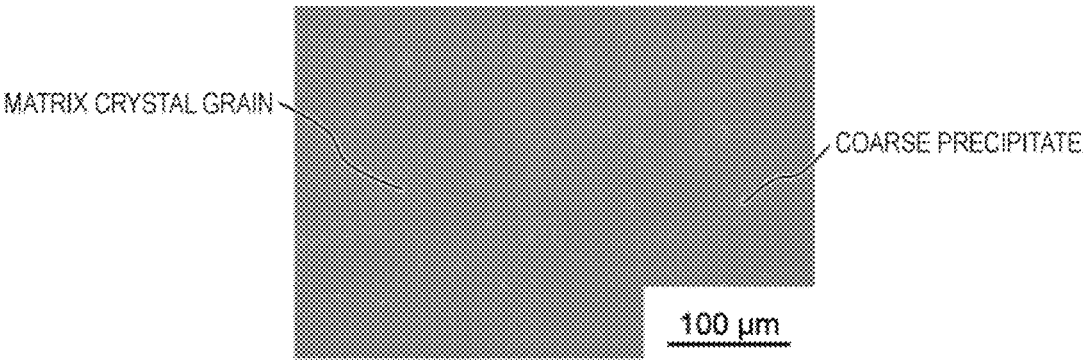
[FIG. 6C]
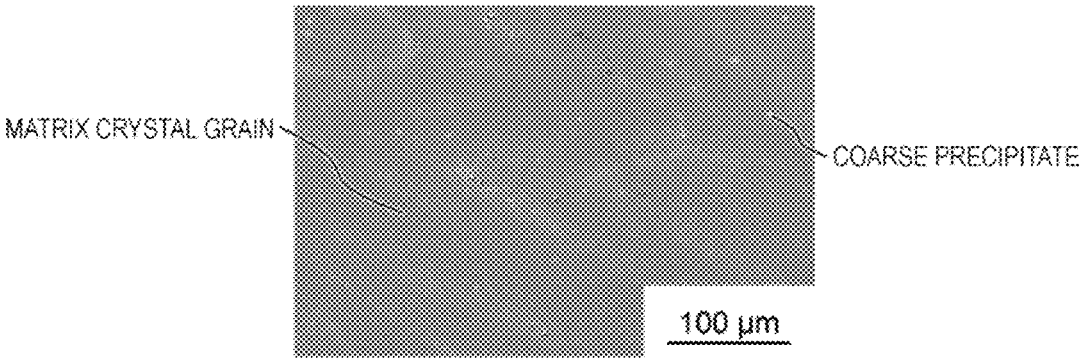
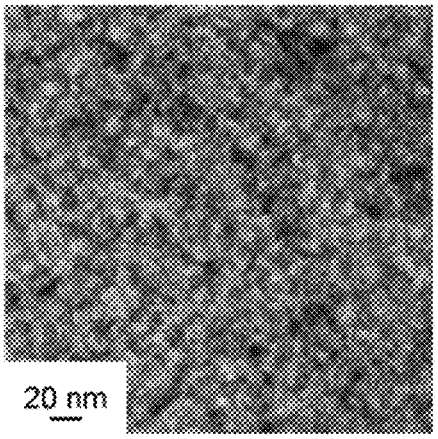
DARK FIELD IMAGE
FIG. 7A
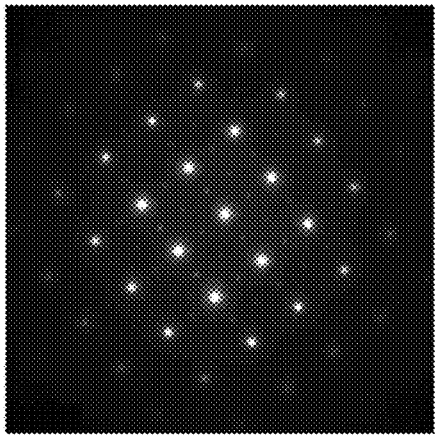
ELECTRON DIFFRACTION PATTERN
FIG. 7B

[FIG. 8]
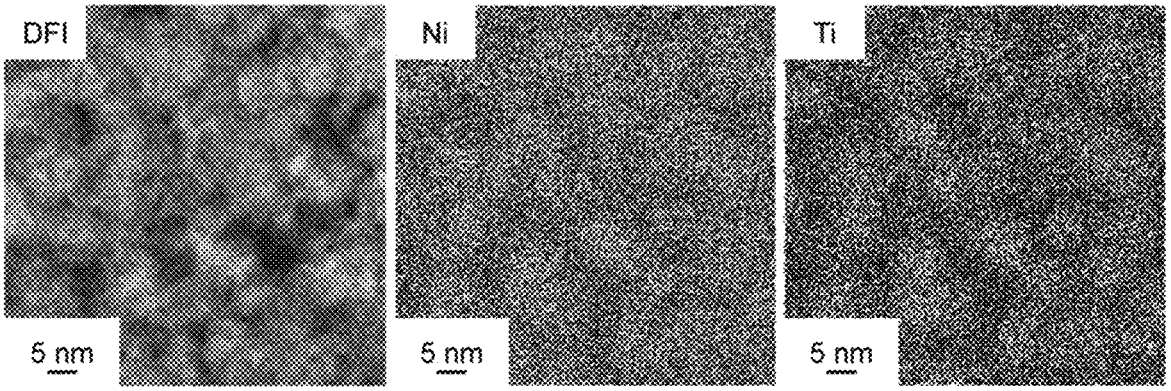

ALLOY MATERIAL, ALLOY PRODUCT FORMED OF ALLOY MATERIAL, AND MECHANICAL DEVICE INCLUDING ALLOY PRODUCT

TECHNICAL FIELD

The present invention relates to a technique of an alloy having excellent corrosion resistance and mechanical characteristics and particularly relates to an alloy material called high-entropy alloy, an alloy product formed of the alloy material, and a mechanical device including the alloy product.

BACKGROUND ART

Recently, as alloys of a new technical idea that is clearly different from technical ideas of alloys in the related art (for example, alloys to which small amounts of multiple kinds of sub-component elements are added to one to three kinds of major component elements), high-entropy alloys (HEA)/multi-principal metal alloys (MPEA) have been proposed. HEA/MPEA are said to be alloys including at least four kinds of principal metal elements (each of which does not account for a majority and accounts for, for example, 5 to 35 at %), and are known to exhibit the following characteristics.

Examples of the characteristics include: (a) stabilization of a mixed state caused by a negative increase in the mixing entropy term of the Gibbs free energy equation; (b) diffusion delay by a complex microstructure; (c) improvement of mechanical characteristics by high lattice strain caused by a difference in size between constituent atoms; and (d) improvement of corrosion resistance caused by a combined effect (also referred to as "cocktail effect") of coexistence of multiple kinds of elements.

For example, PTL 1 (WO2017/138191A) discloses an alloy member formed of a high-entropy alloy, the alloy member including: 5 at % or more and 35 at % or less of each of Co (cobalt), Ni (nickel), Cr (chromium), Fe (iron), and Ti (titanium); more than 0 at % and 8 at % or less of Mo (molybdenum); and a remainder consisting of unavoidable impurities, in which ultrafine particles having an average particle size of 40 nm or less are dispersed and precipitated in matrix crystal.

According to PTL 1, an alloy member having excellent homogeneity in alloy composition and microstructure and excellent shape controllability that is formed of a high-entropy alloy having high mechanical strength and high corrosion resistance can be provided.

In addition, PTL 2 (WO2019/088157A) discloses an alloy material including: 5 at % or more and 35 at % or less of each of Co, Cr, Fe, Ni, and Ti; more than 0 at % and less than 8 at % of Mo; more than 0 at % and 4 at % or less of an element having an atomic radius more than those of Co, Cr, Fe, and Ni; and a remainder consisting of unavoidable impurities.

PTL 2 describes that an alloy material having higher mechanical characteristics and higher corrosion resistance can be provided by adding one or more kinds as elements having a larger atomic radius among Ta, Nb, Hf, Zr, and Y to the chemical composition of PTL 1 as a base.

CITATION LIST

Patent Literature

PTL 1: WO2017/138191A
PTL 2: WO2019/088157A

SUMMARY OF INVENTION

Technical Problem

In the alloy material described in PTL 1 or PTL 2, ultrafine particles are dispersed and precipitated in matrix crystal grains, and excellent mechanical characteristics and corrosion resistance higher than or equal to those of other Ni-based alloys or stainless steel are exhibited. However, in the alloy material, when an undesired intermetallic compound phase (for example, η phase ($Ni_3Ti$ phase) or Laves phase ($Fe_2Ti$ phase)) grows coarsely or aggregates and precipitates, mechanical characteristics (for example, tensile strength or ductility) deteriorate significantly.

The present inventors investigated various applications assuming that the alloy material described in PTL 1 or PTL 2 is a base, and found that it becomes difficult to control precipitates as the volume of an alloy product to be manufactured increases. The present inventors conducted various investigations on the reason and considered that this phenomenon is affected by a difficult control of the cooling rate in a pseudo-solution heat treatment step caused by an increase in the heat capacity of the alloy product.

From the viewpoint of the reliability or manufacturing yield of the alloy product, it is preferable that the alloy product exhibits expected characteristics with high reproducibility without an effect on the volume or heat capacity (hereinafter, referred to as volume/heat capacity). To that end, it is desired that coarse growth or aggregation and precipitation of the undesired intermetallic compound phase can be controlled and suppressed.

Accordingly, an object of the present invention is to provide an alloy material in which coarse growth or aggregation and precipitation of an undesired intermetallic compound phase (for example, η phase ($Ni_3Ti$-based phase) or Laves phase ($Fe_2Ti$-based phase) can be suppressed, an alloy product formed of the alloy material, and a mechanical device including the alloy product.

Solution to Problem (I) According to one aspect of the present invention, there is provided an alloy material including: 5 at % or more and 40 at % or less of each of Co, Cr, Fe, and Ni; more than 0 at % and 8 at % or less of Mo; 1 at % or more and less than 8 at % of Ti; more than 0 at % and 4 at % or less of at least one kind of Ta or Nb; and a remainder consisting of unavoidable impurities, in which a total content of Ti and the at least one kind of Ta or Nb is 3 at % or more and 8 at % or less.

In the present invention, in the above-described alloy material (I), the following improvement or change can be made.

(i) The content of Ti is 2 at % or more and less than 5 at %.

(ii) The content of Co is 25 at % or more and 38 at % or less, the content of Cr is 16 at % or more and 23 at % or less, the content of Fe is 12 at % or more and 20 at % or less, the content of Ni is 17 at % or more and 28 at % or less, and the content of Mo is 1 at % or more and 7 at % or less.

(II) According to another aspect of the present invention, there is provided an alloy product formed of the alloy material, in which when a secondary electron image of a cross-section of the alloy product is observed with a scanning electron microscope, a total occupancy of η phase and Laves phase precipitates having a size of 1 μm or more is 5 area % or less.

In the present invention, in the above-described alloy product (II), the following improvement or change can be made.

(iii) Ultrafine particles having an average particle size of 130 nm or less are dispersed and precipitated in matrix crystal grains of the alloy product.

(III) According to still another aspect of the present invention, there is provided a mechanical device including the above-described alloy product.

Advantageous Effects of Invention

According to the present invention, it is possible to provide an alloy material in which coarse growth or aggregation and precipitation of a predetermined intermetallic compound phase can be suppressed, an alloy product formed of the alloy material, and a mechanical device including the alloy product.

BRIEF DESCRIPTION OF DRAWINGS

FIG. 1 is a scanning electron microscope (SEM) secondary electron image showing an example of a cross-sectional microstructure of an alloy product according to the present invention.

FIG. 2 is a schematic diagram showing a power transmission device that is an example of a mechanical device including the alloy product according to the present invention.

FIG. 3 is a process drawing showing an example of a method of manufacturing the alloy product according to the present invention.

FIG. 4A is a SEM secondary electron image showing a cross-sectional microstructure of a sample of an alloy product P3 formed of an alloy material A3.

FIG. 4B is a SEM secondary electron image showing a cross-sectional microstructure of a sample of an alloy product P2 formed of an alloy material A2.

FIG. 5 is a SEM secondary electron image obtained by observing a sample of an alloy product P1 at a high magnification.

FIG. 6A is a SEM secondary electron image showing a cross-sectional microstructure of a sample of an alloy product P7 formed of an alloy material A7.

FIG. 6B is a SEM secondary electron image showing a cross-sectional microstructure of a sample of an alloy product P8 formed of an alloy material A8.

FIG. 6C is a SEM secondary electron image showing a cross-sectional microstructure of a sample of an alloy product P11 formed of an alloy material A11.

FIGS. 7A and 7B show a dark-field image FIG. 7A and an electron diffraction pattern FIG. 7B of matrix crystal grains obtained by observation with a scanning transmission electron microscope.

FIG. 8 is an image showing an element map of ultrafine particles in matrix crystal grains obtained by energy dispersive X-ray analysis.

DESCRIPTION OF EMBODIMENTS

Fundamental Idea of Present Invention

As described above, the alloy material described in PTL 1 or PTL 2 showed a tendency that it becomes difficult to control precipitates as the volume of an alloy product to be manufactured increases. The present inventors conducted various investigations on the reason and considered that this phenomenon is affected by a difficult control of the cooling rate in a pseudo-solution heat treatment step caused by an increase in the heat capacity of the alloy product.

From the viewpoint of the reliability or manufacturing yield of the alloy product, it is preferable that the alloy product exhibits expected characteristics with high reproducibility without an effect on the volume/heat capacity. To that end, it is desired to obtain an alloy material where coarse growth (for example, precipitates having a size of 1 μm or more) or aggregation and precipitation of the undesired intermetallic compound phase can be controlled and suppressed.

Accordingly, in order to satisfy the above-described requirement, the present inventors conducted a thorough investigation on a component balance (in particular, a balance between components strongly contributing to formation of an undesired intermetallic compound phase (for example, η phase ($Ni_3Ti$-based phase) or Laves phase ($Fe_2Ti$-based phase)) in an alloy. As a result, it was found that, by including at least one kind of Ta or Nb (hereinafter, also referred to as Ta and/or Nb) and further controlling the total content of Ti and Ta and/or Nb, the coarse growth or aggregation and precipitation of a phase or Laves phase can be suppressed. The present invention has been completed based on the finding.

Hereinafter, an embodiment of the present invention will be described in detail with reference to the drawings. The present invention is not limited to the embodiment to be described, and can be appropriately combined with a well-known technique or can be improved based on a well-known technique within a range not departing from the technical idea of the present invention.

[Chemical Composition of Alloy Material]

An alloy material according to the present invention includes: 5 at % or more and 40 at % or less of each of Co, Cr, Fe, and Ni among all of the defined elements; more than 0 at % and 8 at % or less of Mo; 1 at % or more and less than 8 at % of Ti; more than 0 at % and 4 at % or less of at least one kind of Ta or Nb; and a remainder consisting of unavoidable impurities, in which a total content of Ti and the at least one kind of Ta or Nb is 3 at % or more and 8 at % or less.

Co, Cr, Fe, and Ni are basically major component elements forming the alloy material or matrix crystal grains of an alloy product, and are presumed to contribute to the improvement of mechanical strength and corrosion resistance by solid solution strengthening and the cocktail effect. In addition, by including substantially the same moles of the elements, the configurational entropy increases, and a solid solution having a face-centered cubic (fcc) structure is likely to be stabilized.

Hereinafter, the contents of the component elements in the alloy material will be described in more detail. The upper limit value and the lower limit value of component elements described below can be freely combined. In addition, a preferable range, a more preferable range, and a still more preferable range can be appropriately combined.

The content of Co is preferably 20 at % or more and 40 at % or less, more preferably 25 at % or more and 38 at % or less, still more preferably 30 at % or more and 37 at % or less, and still more preferably 32 at % or more and 36 at % or less.

The content of Cr is preferably 10 at % or more and 25 at % or less, more preferably 16 at % or more and 23 at % or less, and still more preferably 18 at % or more and 21 at % or less.

The content of Fe is preferably 10 at % or more and 25 at % or less, more preferably 12 at % or more and 20 at % or less, and still more preferably 14 at % or more and 17 at % or less.

The content of Ni is preferably 15 at % or more and 30 at % or less, more preferably 17 at % or more and 28 at % or less, and still more preferably 21 at % or more and 26 at % or less.

The content of Mo is preferably more than 0 at % and 8 at % or less, more preferably 1 at % or more and 7 at % or less, and still more preferably 2 at % or more and 5 at % or less. Mo is presumed to contribute to the improvement of corrosion resistance together with Cr. When the Mo content is 0 at %, the effect of improving corrosion resistance cannot be obtained. When the Mo content is more than 8 at %, the formation of a brittle intermetallic compound such as a phase (tetragonal system), p phase (rhombohedral system), or Laves phase (face-centered cubic system or hexagonal system) is promoted.

The content of Ti is preferably 1 at % or more and less than 8 at %, more preferably 2 at % or more and less than 7 at %, and still more preferably 2 at % or more and less than 5 at %. Ti is a component forming ultrafine particles that are dispersed and precipitated in the matrix crystal grains and is presumed to contribute to the improvement of the mechanical strength of the alloy material. When the Ti content is less than 1 at %, the effect of improving mechanical strength cannot be obtained. When the Ti content is 8 at % or more, the coarse growth or aggregation and precipitation of the undesired intermetallic compound phase is likely to be induced.

The content of Ta and/or Nb (at least one kind of Ta or Nb) is preferably more than 0 at % and 4 at % or less, more preferably 0.5 at % or more and 3 at % or less, and still more preferably 1 at % or more and 2.5 at % or less. By adding at least one kind of Ta or Nb having a large atomic size, the mechanical characteristics of the alloy product can be further improved by solid solution strengthening. Further, an effect of strengthening a passive film of the alloy product to improve pitting corrosion resistance can also be obtained. When the content of Ta and/or Nb is 0 at %, the effect of improving mechanical characteristics or pitting corrosion resistance cannot be obtained. When the content of Ta and/or Nb is more than 4 at %, the precipitation of the undesired intermetallic compound is promoted.

In the alloy material according to the present invention, the Ti content is further suppressed as compared to an alloy material in the related art, but an appropriate amount of Ta and/or Nb is included. The total content of Ti and Ta and/or Nb among all of the defined elements is preferably 3 at % or more and 8 at % or less, more preferably 4 at % or more and less than 8 at %, and still more preferably 4.5 at % or more and 7.5 at % or less. When the total content of Ti and Ta and/or Nb is less than 3 at %, contribution to strengthening by ultrafine particles or solid solution strengthening is small, and thus the effect of improving mechanical characteristics cannot be obtained. When the total content of Ti and Ta and/or Nb is more than 8 at %, the coarse growth or aggregation and precipitation of the undesired intermetallic compound phase is promoted.

By controlling each of the components to be in the above-described range, the coarse growth or aggregation and precipitation of the undesired intermetallic compound phase can be suppressed. In other words, when each of the components deviates from the preferable composition range, it is difficult to achieve desired characteristics.

The unavoidable impurities refer to components that are difficult to completely remove and are desired to be removed as much as possible. Examples of the unavoidable impurities include Si (silicon), P (phosphorus), S (sulfur), N (nitrogen), and O (oxygen). The total content of the unavoidable impurities is preferably 1 mass % or less. In other words, the total content of the components that are intentionally included is preferably 99 mass % or more with respect to the total mass of the alloy.

Regarding the content of the unavoidable impurities, for example, the content of Si is preferably 0.2 mass % or less, more preferably 0.1 mass % or less, and still more preferably 0.05 mass % or less. The content of P is preferably 0.1 mass % or less, more preferably 0.05 mass % or less, and still more preferably 0.02 mass % or less. The content of S is preferably 0.1 mass % or less, more preferably 0.05 mass % or less, and still more preferably 0.02 mass % or less. The content of N is preferably 0.1 mass % or less, more preferably 0.05 mass % or less, and still more preferably 0.02 mass % or less. The content of O is preferably 0.2 mass % or less, more preferably 0.1 mass % or less, and still more preferably 0.05 mass % or less.

[Alloy Product formed of Alloy Material]

(Microstructure)

An alloy product formed of the alloy material according to the present invention has a microstructure including: matrix crystal grains; and $L1_2$-type ordered phase ultrafine particles that are dispersed and precipitated in the matrix crystal grain.

It is preferable that the matrix crystal grains are equiaxial grains having an average grain size of 300 μm or less and the crystal structure thereof is face-centered cubic (FCC). When the average grain size is 300 μm or less, mechanical characteristics or corrosion resistance is improved. The average particle size of the matrix crystal grains is preferably 200 μm or less and more preferably 150 μm or less. In the present invention, the crystal structure of the matrix crystal grains may include simple cubic (SC). In addition, in the present invention, the average grain size of the matrix crystal grains is obtained by processing an image of microstructure observation to obtain the diameter of an equivalent area circle of each of the matrix crystal grains and obtaining the average of the diameters. Unless specified otherwise, any software can be used as image analysis software.

The average particle size of the ultrafine particles to be dispersed and precipitated is 130 nm or less, preferably 10 nm or more and 130 nm or less, and more preferably 20 nm or more and 100 nm or less. When the average particle size of the ultrafine particles is 10 nm or more and 130 nm or less, the mechanical characteristics are improved. In the present invention, the average particle size of the ultrafine particles is obtained by processing an image of microstructure observation to obtain the maximum length of each of the ultrafine particles and obtaining the average of the maximum lengths.

Further, in the alloy product, the coarse growth or aggregation and precipitation of r phase ($Ni_3Ti$-based phase) or Laves phase ($Fe_2Ti$-based phase) is suppressed. Specifically, when a secondary electron image of a cross-section of the alloy product (for example, 400 μm×300 μm) is observed with a scanning electron microscope (SEM), an occupancy of η phase and/or Laves phase precipitates (coarse precipitates) having a size of 1 μm or more is 5 area % or less. The occupancy is more preferably 2 area % or less and still more preferably 1 area % or less.

"Size" of "size of 1 μm or more" refers to the maximum length of a precipitate when an image of microstructure observation is processed. In addition, the n phase and the Laves phase include phases formed of $Ni_3Ti$ or $Fe_2Ti$ and phases where a part of Ni, Fe, and Ti forming the phases is substituted with another component.

FIG. 1 is a SEM secondary electron image showing an example (alloy product P1 described below) of the cross-sectional microstructure of the alloy product according to the present invention. As shown in FIG. 1, in the alloy product according to the present invention, the coarse growth or aggregation and precipitation or n phase or Laves phase is suppressed. Specifically, in FIG. 1, when measured by image analysis, the occupancy of coarse precipitates of η phase and/or Laves phase is extremely small at 0.3 area %.

In the alloy product according to the present invention, the matrix crystal grains mainly include face-centered cubic that is one kind of the closest packed structure, the ultrafine particles are dispersed and precipitated in the matrix crystal grains, and the formation of coarse precipitates of n phase or Laves phase is suppressed. As a result, it is considered that excellent corrosion resistance and excellent mechanical characteristics are simultaneously achieved.

The alloy product according to the present invention can be suitably used as a member where high mechanical characteristics are required in a harsh environment because corrosion resistance and mechanical characteristics can be improved. Examples of the member include a member for a turbine such as a turbine blade, a member for a boiler, a member for an engine, a member for a nozzle, a structural material for a plant such as a casing, a pipe, a valve, or a pump, a structural material for a power generator, a structural material for a nuclear reactor, an aerospace structural material, a member for hydraulic equipment, and mechanism members of various equipment such as a bearing, a piston, a gear, or a rotating shaft.

[Mechanical Device Including Alloy Product]

In a mechanical device according to the present invention, high mechanical characteristics can be improved in a harsh environment. For example, a turbine, a boiler, an engine, a nozzle, a plant, a power generator, a nuclear reactor, an aerospace structural material, a hydraulic equipment, or other various equipment are preferable. For example, FIG. 2 is a schematic diagram showing an example of a power transmission device. By combining the alloy products (a first gear, a first rotating shaft, a second gear, and a second rotating shaft), a power transmission device having excellent corrosion resistance and durability can be obtained.

A method of manufacturing each of the first gear, the first rotating shaft, the second gear, and the second rotating shaft is not particularly limited. From the viewpoint of mass productivity, a casting and forging method, a powder-metallurgy method, or an additive manufacturing method can be suitably used. In addition, FIG. 2 shows a gear mechanism using a spur gear. The power transmission device according to the present invention is not limited to a spur gear and may be another gear (for example, an internal gear, a helical gear, a screw gear, or a bevel gear).

[Method of Manufacturing Alloy Product]

FIG. 3 is a process drawing showing an example of a method of manufacturing the alloy product according to the present invention. As shown in FIG. 3, schematically, the method of manufacturing the alloy product according to the present invention schematically includes an alloy material preparation step S1 and a forming step S2 and further includes a pseudo-solution heat treatment step S3 or a sintering step S4 depending on the forming process. Hereinafter, each of the steps will be described in more detail.

(Alloy Material Preparation Step)

First, the alloy material preparation step S1 of preparing the alloy material that is a base of the alloy product is performed. As long as the alloy material for forming the desired alloy product can be obtained, the detailed procedure of the alloy material preparation step S1 is not particularly limited. For example, the alloy material preparation step S1 includes: a raw material mixing and melting step S1*a* of mixing and melting raw materials to form molten metal such that a desired alloy composition is obtained; and an alloy solidification step S1*b* of solidifying the molten metal to obtain the alloy material.

The raw material mixing and melting step S1*a* is not particularly limited as long as it is a step of mixing and melting raw metal to obtain molten metal. For example, in order to further reduce the content of the impurity components in the alloy (to refine the alloy), the raw material mixing and melting step S1*a* may be a step including: a melting step of mixing and temporarily melting the raw metal to obtain molten metal; an alloy ingot forming step of temporarily solidifying the molten metal to form an alloy ingot for remelting; and a remelting step of remelting the alloy ingot for remelting to obtain purified molten metal. A method of remelting is not particularly limited as long as the cleanliness of the alloy can be increased. For example, vacuum arc remelting (VAR) can be preferably used.

The alloy solidification step S1*b* is not particularly limited as long as the alloy material in a form (for example, an alloy ingot (ingot) or alloy powder) that is suitable for use in the forming step S2 as the next step can be obtained. For example, a casting method or an atomization method can be suitably used. When the ingot is prepared using the casting method, the coarse growth or aggregation and precipitation of η phase or Laves phase can be suppressed in the alloy material according to the present invention. Therefore, even an ingot having a high volume/heat capacity is advantageous in that undesired solidification cracking caused by coarse precipitates can be suppressed.

On the other hand, when the alloy powder is prepared using the atomization method in the alloy solidification step S1*b*, from the viewpoint of the fluidity or fill density of the alloy powder when a forming process (for example, a powder-metallurgy process or an additive manufacturing process) is performed using the alloy powder in the forming step S2 as the next step, the average particle size of the alloy powder is preferably 5 μm or more and 200 μm or less, more preferably 10 μm or more and 100 μm or less, and still more preferably 10 μm or more and 50 μm or less. In the present invention, the average particle size of the alloy powder is a volume-weighted average particle size measured using a laser diffraction particle size distribution analyzer.

When the average particle size of the alloy powder is 5 μm or more, the fluidity of the alloy powder in the forming step S2 is maintained, and the effect on the form accuracy of a compact is small. In addition, when the average particle size of the alloy powder is 200 μm or less, the fill density of the alloy powder in the forming step S2 is maintained. Deterioration in fill density causes formation of an internal cavity in the compact or surface roughening.

As a result, a powder classification step of classifying the alloy powder having an average particle size of 5 μm or more and 200 μm or less may be further performed. The powder classification step is not an essential step and is preferably performed from the viewpoint of improving the utilization of the alloy powder. When the particle size distribution of the alloy powder is measured and is verified to be in a desired range, it can be considered that the step is performed.

(Forming Step)

Next, the forming step S2 of forming a compact having a desired shape using the alloy material obtained in the alloy material preparation step S1 is performed. A forming method is not particularly limited as long as the compact having the desired shape can be formed. For example, when the alloy material is the ingot, cutting, plastic forming (for example, forging, drawing, or rolling), or machining (for example, punching or cutting) can be appropriately used.

On the other hand, when the alloy material is the alloy powder, a powder-metallurgy process or an additive manufacturing process can be suitably used. The powder-metallurgy process or the additive manufacturing process is not particularly limited, and a process in the related art can be appropriately used.

The additive manufacturing method (AM) is a process of building and forming a compact having a desired shape from the alloy powder, and an alloy product having a near net shape can be manufactured by local melting and rapid solidification instead of sintering. Therefore, the additive manufacturing method has a characteristic that a member having mechanical characteristics equivalent to that of a forged product and having a complex three-dimensional shape can be directly manufactured. As the AM method, for example, a selective laser melting method (SLM), an electron beam melting method (EBM), or a directed energy deposition method (DED) can be used.

The additive manufacturing process using the SLM method will be simply described. The additive manufacturing process is a process of forming the compact by repeating the following steps including: an alloy powder bed preparation step of laying the alloy powder to prepare an alloy powder bed having a predetermined thickness; and a laser melting solidification step of irradiating a predetermined region of the alloy powder bed with a laser beam to solidify the alloy powder in the region by local melting and rapid solidification.

More specifically, in order to increase the density and the form accuracy of the compact as much as possible, for example, the thickness h of the alloy powder bed is set in a range of 0.02 mm or more and 0.2 mm or less, the power P of the laser beam is set in a range of 50 W or more and 1000 W or less, the scanning speed S of the laser beam is set in a range of 50 mm/s or more and 10000 mm/s or less, and the scanning interval L of the laser beam is set in a range of 0.05 mm or more and 0.2 mm or less. The volume energy density E of local melting represented by "$E=P/(h\times S\times L)$ is preferably controlled in a range of 20 J/mm$^3$ or more and 200 J/mm$^3$ or less and is more preferably controlled in a range of 40 J/mm$^3$ or more and 150 J/mm$^3$ or less.

The compact formed using the SLM method is embedded in the alloy powder bed. Therefore, the additive manufacturing process may include an extraction step of extracting the compact from the alloy powder bed after the laser melting solidification step. A method of extracting the compact is not particularly limited, and a method in the related art can be used. In the EBM method, sand blasting using the alloy powder can be preferably used in the extraction step. Sand blasting using the alloy powder is advantageous in that the removed alloy powder bed can be crushed to be reused as the alloy powder.

In addition, when the alloy material is the alloy powder, in order to improve the form accuracy of the compact, for example, cutting, plastic forming, or machining may be further performed on the compact formed by the additive manufacturing process or the powder-metallurgy process.

(Pseudo-Solution Heat Treatment Step)

The pseudo-solution heat treatment step S3 is a heat treatment step that is performed on the compact formed from the ingot or the compact prepared in the additive manufacturing process, and is performed in order to homogenize segregated matter or the composition distribution that may remain in the compact. Regarding the alloy material according to the present invention, an academically approved knowledge such as a phase equilibrium diagram is not currently present, and a temperature at which a heat treatment is performed on the segregated matter to form a solid solution cannot be accurately defined. Therefore, the heat treatment in this step is called a pseudo-solution heat treatment.

The temperature of the heat treatment is preferably 1000° C. or higher and 1250° C. or lower, more preferably 1050° C. or higher and 1200° C. or lower, and still more preferably 1100° C. or higher and 1180° C. or lower. When the temperature of the heat treatment is 1000° C. or higher, sufficient homogenization is performed. When the temperature of the heat treatment is 1250° C. or lower, the matrix crystal grains are not excessively coarsened, and corrosion resistance or mechanical characteristics are improved. The heat treatment atmosphere is not particularly limited and may be air or may be a non-oxidizing atmosphere (an atmosphere where oxygen is not substantially present, for example, in a vacuum, in high purity argon, or in high purity nitrogen).

In addition, the holding time in the heat treatment may be appropriately set in a range of 0.1 hours or longer and 100 hours or shorter in consideration of the volume/heat capacity and the temperature of the heat treatment target. In the alloy material and the alloy product according to the present invention, the formation of η phase or Laves phase coarse precipitates is suppressed. Therefore, even when the cooling rate after holding at a high temperature is slower than that of the alloy material in the related material, the microstructure where the nano-sized ultrafine particles are dispersed and precipitated in the matrix crystal grains can be obtained. Accordingly, cooling means can be freely selected, and the cooling rate can be easily managed. For example, water cooling, air cooling, or nitrogen cooling in a vacuum can be performed.

In addition, even when uniform cooling adjustment is required, for example, when the volume of the alloy product is high, a homogeneous internal structure where defects or precipitates at the center do not occur is likely to be obtained, and mechanical characteristics and the like can be maintained. From the viewpoint of controlling the average particle size of the ultrafine particles, it is preferable to rapidly pass a temperature range (for example, a temperature range of 900° C. to 800° C.) where the intermetallic compound phase is likely to grow.

(Sintering Step)

The sintering step S4 is a heat treatment step that is performed on the compact formed in the powder-metallurgy process. A heat treatment method is not particularly limited, and a method in the related art can be used. For example, the forming step S2 and the sintering step S4 may be performed completely independent of each other (only forming is performed in the forming step S2, and only sintering is performed in the sintering step S4), and the forming step S2 and the sintering step S4 may be integrally performed as in hot isostatic press method (HIP).

The sintering temperature is not particularly limited. For example, the same temperature range as that of the pseudo-solution heat treatment S3 can be used. That is, the sintering temperature is preferably 1000° C. or higher and 1250° C. or lower, more preferably 1050° C. or higher and 1200° C. or lower, and still more preferably 1100° C. or higher and 1180° C. or lower.

(Finishing Step)

Although not shown in FIG. 3, optionally, a surface finishing step may be further performed on the alloy product obtained in the pseudo-solution heat treatment step S3 or the sintering step S4, if necessary.

EXAMPLES

Hereinafter, the present invention will be described in detail based on Examples and Comparative examples. The present invention is not limited to these experimental examples.

Experiment 1

(Preparation of Alloy Materials A1 to A6)

First, raw metals were mixed according to compositions of alloy materials A1 to A6 shown in Table 1 below to prepare mixed raw materials for preparing the alloy materials A1 to A6, respectively. Next, regarding each of the mixed raw materials of the alloy materials A1 to A6, the mixed raw material disposed on a water cooling copper hearth in a reduced pressure Ar atmosphere was melted with an arc melting method using an automatic arc melting furnace (manufactured by Diavac Ltd.) to obtain molten metal, and the molten metal was solidified to prepare an alloy ingot (diameter: about 34 mm, mass: about 50 g). Further, by repeating remelting six times to homogenize the alloy ingot while inverting the alloy ingot, the alloy materials A1 to A6 were prepared (alloy material preparation step).

TABLE 1

Alloy Compositions of Alloy Materials A1 to A6 (Unit: at %)

| Alloy Material | Co | Cr | Fe | Ni | Mo | Ti | Ta | Nb | Ti + Ta + Nb |
|---|---|---|---|---|---|---|---|---|---|
| A1 | 34.4 | 19.7 | 14.5 | 23.5 | 2.4 | 4.5 | 1.0 | — | 5.5 |
| A2 | 32.6 | 19.7 | 14.5 | 23.5 | 2.4 | 6.7 | 0.5 | 0.1 | 7.3 |
| A3 | 31.0 | 19.7 | 14.5 | 23.5 | 2.4 | 8.9 | — | — | 8.9 |
| A4 | 26.5 | 17.8 | 17.8 | 26.7 | 1.8 | 8.9 | 0.5 | — | 9.4 |
| A5 | 26.5 | 17.7 | 17.7 | 26.5 | 1.8 | 8.8 | 1.0 | — | 9.8 |
| A6 | 26.3 | 17.6 | 17.6 | 26.4 | 1.8 | 8.8 | 1.5 | — | 10.3 |

"—" represents that the element was not intentionally included

As shown in Table 1, the alloy materials A1 and A2 are the alloy materials (Examples) according to the present invention, and the alloy materials A3 to A6 are alloy materials (Comparative Examples) deviating from the definition of the present invention.

Experiment 2

(Preparation of Alloy Products P1 to P6)

Next, each of the alloy materials A1 to A6 was machined to form a compact (diameter 20 mm×height 10 mm (forming step).

Next, regarding each of the compacts formed of the alloy materials A1 to A6, a pseudo-solution heat treatment of holding the compact in a vacuum at 1120° C. for 1 hour and subsequently cooling the compact was performed (pseudo-solution heat treatment step). Cooling after holding at a high temperature was performed by introducing and circulating nitrogen gas into the furnace.

In addition, in order to further clarify the operation and effects of the present invention (to suppress the formation of η phase or Laves phase coarse precipitates), an aging heat treatment of holding the compact on which the pseudo-solution heat treatment was performed in air at 650° C. for 24 hours was performed. As a result, samples of the alloy products P1 to P6 were prepared.

Experiment 3

(Test and Evaluation of Alloy Products P1 to P6)

(Microstructure Observation) First, X-ray diffraction (XRD) analysis was performed on the samples of the alloy products P1 to P6 to identify the crystal structure and the precipitated phase of the matrix crystal grains. As a result, in all of the alloy products P1 to P6, it was determined that the crystal structure of the matrix crystal grains was mainly formed of fcc. Here, since it was difficult to completely distinguish between face-centered cubic (fcc) and simple cubic (sc) from the XRD analysis, whether or not to include sc was not able to be determined.

Regarding the precipitated phase, in the samples of the alloy products P3 to P6 according to Comparative examples, η phase and/or Laves phase was detected. On the other hand, in the samples of the alloy products P1 and P2 according to Examples, η phase and Laves phase were not detected. This result indicates that, even when any precipitated phase was present in the samples of the alloy products P1 and P2, the size of the precipitated phase was extremely small.

Next, a cross-section of one cut piece of each of the samples of the alloy products P1 to P6 was mirror-polished and was electrolytically etched (10 mass % oxalic acid aqueous solution, an electric field condition of 3 V×0.2 A). The treated cross-section was observed with a SEM (observation area=400 μm×300 μm) to measure an occupancy of η phase and/or Laves phase precipitates (coarse precipitates) having a size of 1 μm or more by image analysis. A case where the occupancy of the coarse precipitates was more than 5 area % was evaluated as "Fail", a case where the occupancy of the coarse precipitates was 5 area % or less was evaluated as "Pass", and a case where the occupancy of the coarse precipitates was 2 area % or less was evaluated as "Good".

FIG. 4A is a SEM secondary electron image showing a cross-sectional microstructure of the sample of the alloy product P3 formed of the alloy material A3 (Comparative Example). FIG. 4B is a SEM secondary electron image showing a cross-sectional microstructure of the sample of the alloy product P2 formed of the alloy material A2 (Example). In addition, FIG. 1 described above is a SEM secondary electron image showing the sample of the alloy product P1 formed of the alloy material A1 (Example).

As shown in FIG. 4A, in the sample of the alloy product P3 according to Comparative Example, η phase and/or Laves phase coarse precipitates were clearly observed. The occupancy of the coarse precipitates was measured as 21.3 area %. Although not shown in the drawing, in the samples of the alloy products P4 to P6 according to Comparative Examples, as in the sample of the alloy product P3, η phase and/or Laves phase coarse precipitates were clearly observed.

On the other hand, as shown in FIGS. 4B and 1, in the samples of the alloy product P2 and the alloy product P1 according to Examples, the amount of the coarse precipitates was small, and it was verified that the coarse growth or aggregation and precipitation of 9 phase and Laves phase was suppressed. The occupancies of the coarse precipitates in the samples of the alloy product P2 and the alloy product P1 were measured as 2.4 area % and 0.3 area %, respectively.

The measurement results of the occupancy of the q phase and/or Laves phase coarse precipitates are collectively shown in Table 2 below. It is expected from the results of the microstructure observation that the samples of the alloy products according to Examples exhibited higher ductility or toughness than Comparative Examples.

Further, the samples of the alloy products P1 to P6 were observed at a high magnification (about 10000 to 50000-fold). FIG. 5 is a SEM secondary electron image obtained by observing the sample of the alloy product P1 at 20000-fold. It was verified from FIG. 5 that the ultrafine particles were dispersed and precipitated in the matrix crystal grains. In this experiment, the average particle size of the ultrafine particles was calculated by processing the image of the SEM secondary electron image (observation area=3 μm×3 μm) to obtain a major axis length (maximum length) of each of the ultrafine particles and obtaining the average of the major axis lengths.

A case where the average particle size of the ultrafine particles was more than 130 nm was evaluated as "Fail", a case where the average particle size of the ultrafine particles was 130 nm or less was evaluated as "Pass", and a case where the average particle size of the ultrafine particles was 100 nm or less was evaluated as "Good". The measurement and evaluation results of the average particle size of the ultrafine particles are collectively shown in Table 2. It can be seen from the results of Table 2 that the samples of the alloy products P1 and P2 according to Examples were evaluated as "Good", and the samples of the alloy products P3 to P6 according to Comparative Examples were evaluated as "Fail". It is presumed from the result that, in the samples of the alloy products according to Examples, the coarsening of the ultrafine particles dispersed and precipitated in the matrix crystal grains was suppressed.

(Vickers Hardness Measurement)

Regarding another cut piece of each of the samples of the alloy products P1 to P6, the Vickers hardness (HV) at room temperature was measured as an index representing the mechanical strength. Using a micro Vickers hardness tester (MMT-X series, manufactured by Matsuzawa Co., Ltd.), the Vickers hardness was measured at 10 points (load: 200 gf, holding time: 15 seconds), and the average value of the measured values at 8 points excluding the maximum value and the minimum value among the Vickers hardness values at the 10 points was obtained as the Vickers hardness of the sample.

A case where the Vickers hardness was HV 450 or higher was evaluated as "Pass", and a case where the Vickers hardness was lower than HV 450 was evaluated as "Fail". As a result, all of the samples of the alloy products P1 to P6 were evaluated as Pass. The results of the Vickers hardness measurement are collectively shown in Table 2. In other words, it is considered that the samples of the alloy products according to Examples exhibited the mechanical strength equivalent to those of Comparative Examples.

(Pitting Corrosion Test)

A pitting corrosion test was performed as a corrosion resistance test. Samples of the alloy products P1 to P6 were separately prepared, and polarization test pieces (length 15 mm×width 15 mm×thickness 2 mm) for the pitting corrosion test were collected. The pitting corrosion test was performed on each of the polarization test pieces according to JIS G 0577. Specifically, under conditions of "test area: 1 $cm^2$, a clearance corrosion prevention electrode mounted on the polarization test piece, reference electrode: a saturated silver-silver chloride electrode, test solution: 3.5 mass % sodium chloride aqueous solution from which argon gas was degassed, test temperature: 80° C., and potential sweeping rate: 20 mV/min", an anode polarization curve of the polarization test piece was measured to obtain a pitting potential (unit: V vs. Ag/AgCl) corresponding to the current density of 100 $\mu A/cm^2$.

Regarding the evaluation of the pitting corrosion test, a case where the pitting potential was lower than 0.50 V was evaluated as "Fail", a case where the pitting potential was 0.50 V or higher was evaluated as "Pass", and a case where the pitting potential was 1.00 V or higher was evaluated as "Good". The results of the pitting corrosion test are collectively shown in Table 2. As a result, the samples of the alloy products P2 to P6 were evaluated as Pass, and the sample of the alloy product P1 was evaluated as Good. In other words, it can be said that the samples of the alloy products according to Examples exhibited the corrosion resistance higher than or equal to those of Comparative Examples.

TABLE 2

Results of Test and Evaluation of Alloy Products P1 to P6

| | | Microstructure Observation | | | | | | Corrosion Resistance | |
|---|---|---|---|---|---|---|---|---|---|
| | | Occupancy | | Average Particle Size | | Mechanical Characteristics | | Pitting | |
| Alloy Product | Alloy Material | of Coarse Precipitates (area %) | Evaluation | of Ultrafine Particles (nm) | Evaluation | Vickers Hardness (HV) | Evaluation | Potential (V vs. Ag/AgCl) | Evaluation |
| P1 | A1 | 0.3 | Good | 70 | Good | 474 | Pass | 1.05 | Good |
| P2 | A2 | 2.4 | Pass | 94 | Good | 491 | Pass | 0.52 | Pass |
| P3 | A3 | 21.3 | Fail | 161 | Fail | 499 | Pass | 0.77 | Pass |
| P4 | A4 | 12.3 | Fail | 142 | Fail | 501 | Pass | 0.61 | Pass |
| P5 | A5 | 35.0 | Fail | 166 | Fail | 518 | Pass | 0.59 | Pass |
| P6 | A6 | 28.2 | Fail | 168 | Fail | 499 | Pass | 0.74 | Pass |

Experiment 4

(Preparation of Alloy Materials A7 to A11)

Using the same method as that of Experiment 1, alloy materials A7 to A11 were prepared according to compositions shown in Table 3. The alloy materials A7 to A11 are the alloy materials (Examples) according to the present invention.

TABLE 3

Alloy Compositions of Alloy Materials A7 to A11 (Unit: at %)

| Alloy Material | Co | Cr | Fe | Ni | Mo | Ti | Ta | Nb | Ti + Ta + Nb |
|---|---|---|---|---|---|---|---|---|---|
| A7 | 33.4 | 19.7 | 14.5 | 23.5 | 2.4 | 5.5 | 1.0 | — | 6.5 |
| A8 | 35.4 | 19.7 | 14.5 | 23.5 | 2.4 | 3.5 | 1.0 | — | 4.5 |
| A9 | 33.9 | 19.7 | 14.5 | 23.5 | 2.4 | 4.5 | 1.5 | — | 6.0 |
| A10 | 34.9 | 19.7 | 14.5 | 23.5 | 2.4 | 4.5 | 0.5 | — | 5.0 |
| A11 | 33.9 | 19.7 | 14.5 | 23.5 | 2.4 | 4.5 | 1.0 | 0.5 | 5.5 |

"—" represents that the element was not intentionally included

Experiment 5

(Preparation of Alloy Products P7 to P11)

Using each of the alloy materials A7 to A11, a compact was formed using the same method as that of Experiment 2. A pseudo-solution heat treatment of holding each of the compacts in a vacuum at 1120° C. for 1 hour and cooling the compact was performed. Cooling after holding at a high temperature was performed by introducing and circulating nitrogen gas into the furnace.

Next, the aging heat treatment was performed on the compact on which the pseudo-solution heat treatment was performed. Regarding the alloy products P7, P9, and P11, an aging heat treatment of holding the compact in air at 650° C. for 8 hours was performed. In addition, regarding the alloy products P8 and P10, an aging heat treatment of holding the compact in air at 700° C. for 8 hours was performed. As a result, samples of the alloy products P7 to P11 were prepared.

Experiment 6

(Test and Evaluation of Alloy Products P7 to P11)

Using the same method as that of Experiment 3, the microstructure observation and the Vickers hardness measurement of the alloy products P7 to P11 were performed and evaluated. The measurement and evaluation results are shown in Table 4.

In addition, FIG. 6A is a SEM secondary electron image showing a cross-sectional microstructure of the sample of the alloy product P7 formed of the alloy material A7. FIG. 6B is a SEM secondary electron image showing a cross-sectional microstructure of the sample of the alloy product P8 formed of the alloy material A8. FIG. 6C is a SEM secondary electron image showing a cross-sectional microstructure of the sample of the alloy product P11 formed of the alloy material A11.

TABLE 4

Results of Test and Evaluation of Alloy Products P7 to P11

| | | Microstructure Observation | | | | Mechanical Characteristics | |
|---|---|---|---|---|---|---|---|
| | | Occupancy of Coarse Precipitates | | Average Particle Size of Ultrafine Particles | | Vickers Hardness | |
| Alloy Product | Alloy Material | (area %) | Evaluation | (nm) | Evaluation | (HV) | Evaluation |
| P7 | A7 | 1.3 | Good | 78 | Good | 497 | Pass |
| P8 | A8 | 0.1 | Good | 96 | Good | 455 | Pass |
| P9 | A9 | 0.6 | Good | 56 | Good | 486 | Pass |
| P10 | A10 | 0.06 | Good | 58 | Good | 457 | Pass |
| P11 | A11 | 0.1 | Good | 62 | Good | 487 | Pass |

As shown in FIGS. 6A to 6C and Table 4, it was verified that, in the samples of the alloy products P7 to P11, even as compared to the sample (refer to FIG. 4B and Table 2) of the alloy product P2 according to Example, the amount of precipitates was further reduced, and the coarse growth or aggregation and precipitation of r phase and Laves phase was suppressed. In all of the alloy products P7 to P11, the occupancy of the coarse precipitates was evaluated as "Good", and the average particle size of the ultrafine particles was also evaluated as "Good". In all of the alloy products P7 to P11, the Vickers hardness was HV 450 or higher and was evaluated as "Pass".

Although not shown in the drawing, in the samples of the alloy products P9 and P10, as in the samples of the alloy products P8 and P11, η phase and/or Laves phase coarse precipitates were clearly observed. In the experiment, the pitting corrosion test was not performed, but it is considered from the results of the occupancy of coarse precipitates that all of the alloy products P7 to P11 were evaluated as "Good".

Experiment 7

(Preparation of Alloy Material A12)

Raw metals were mixed according to compositions shown in Table 5 and were melted in a high frequency melting furnace to form molten metal (raw material mixing and melting step). Next, alloy powder was formed from the molten metal using a gas atomization method (alloy solidification step). Next, the obtained alloy powder was classified through a sieve to screen particles having a particle size of 20 to 45 μm, and an alloy material A12 was prepared. When a particle size distribution of the alloy material A12 was measured using a laser diffraction particle size distribution analyzer, the average particle size was about 30 μm. As shown in Table 5, the alloy material A12 is the alloy material (Examples) according to the present invention.

TABLE 5

| Alloy Composition of Alloy Material A12 (Unit: at %) | | | | | | | | | |
|---|---|---|---|---|---|---|---|---|---|
| Alloy Material | Co | Cr | Fe | Ni | Mo | Ti | Ta | Nb | Ti + Ta + Nb |
| A12 | 34.4 | 19.7 | 14.5 | 23.5 | 4.5 | 2.4 | 1.0 | — | 3.4 |

"—" represents that the element was not intentionally included

Experiment 8

(Preparation of Alloy Product P12)

Using an additive manufacturing device (model: EOSINT M280, manufactured by Electro Optical Systems GmbH), a compact (a prism material (the height direction is a laminating direction) having length 25 mm×width 25 mm×height 70 mm) formed of the alloy material A12 was formed using the SLM method through the above-described steps. As additive manufacturing conditions, the power P of the laser beam, the scanning speed S of the laser beam, and the scanning interval L of the laser beam were controlled such that the thickness h of the alloy powder bed was 0.04 mm and the volume energy density E was 40 to 100 J/mm$^3$.

After the extraction step, a pseudo-solution heat treatment of holding the compact in air at 1120° C. for 3 hours and cooling the compact was performed. Further, an aging heat treatment of holding the compact in air at 700° C. for 8 hours and cooling the compact was performed. As a cooling method, air cooling (the average cooling rate in a range of 900° C. to 800° C. was about 10° C./s) was adopted. As a result, an alloy product P12 formed of the alloy material A12 using the additive manufacturing method was prepared.

Experiment 10

(Test and Evaluation of Alloy Product P12)

Using the same method as that of Experiment 3, the microstructure observation and the Vickers hardness measurement of the alloy product P12 were performed and evaluated. In addition, a room temperature tensile test was performed according to ASTM E8 to measure a 0.2% proof stress, a tensile strength, and a fracture elongation. The measurement and evaluation results are shown in Table 6.

TABLE 6

| Results of Test and Evaluation of Alloy Products P12 | | | | | | | | | | |
|---|---|---|---|---|---|---|---|---|---|---|
| | | Microstructure Observation | | | | Mechanical Characteristics | | | | |
| | | | | Average | | | | Tensile Test | | |
| | | Occupancy | | Particle Size | | Vickers Hardness Test | | 0.2% | | |
| Alloy Product | Alloy Material | of Coarse Precipitates (area %) | Evaluation | of Ultrafine Particles (nm) | Evaluation | Vickers hardness (HV) | Evaluation | Proof Stress (MPa) | Tensile Strength (MPa) | Fracture Elongation (%) |
| P12 | A12 | 0.03 | Good | 10 to 20 | Good | 480 | Pass | 981 | 1485 | 36 |

As shown in Table 6, the occupancy of the coarse precipitates was extremely small at 0.03 area %, and was evaluated as "Good" together with the average particle size of the ultrafine particles. The Vickers hardness was also HV 450 or higher and was evaluated as "Pass". In addition, as a result of the tensile test, it was verified that excellent fracture elongation was exhibited while exhibiting a sufficiently high 0.2% proof stress and a sufficiently high tensile strength.

(Ultrafine Particle Observation and Analysis)

Using a scanning transmission electron microscope-energy dispersive X-ray analyzer (STEM-EDX, Model: JEM-ARM200F, manufactured by JEOL Ltd.), the ultrafine particle in the matrix crystal grains of the alloy product P12 was observed at a high magnification and analyzed.

First, one surface of a sample of an alloy product FA1 was mirror-polished, and a test piece having a thickness of about 100 nm was cut out from the polished surface with a micro sampling method using a focused ion beam processing device (model: FB-2100, manufactured by Hitachi High-Tech Corporation). The obtained test piece was observed at a high magnification and analyzed.

FIG. 7 shows a dark-field image (DFI) (a) of the matrix crystal grains and an electron diffraction pattern (b) of the matrix crystal grains obtained by observation with an STEM. FIG. 8 is an image showing an element map of the ultrafine particles in the matrix crystal grains obtained by EDX.

It can be verified from the dark-field image (a) of FIG. 7 that ultrafine particles having a particle size of about 10 to 20 nm were dispersed and precipitated, and a pattern derived from face-centered cubic (fcc) phase and a pattern derived from γ' phase can be verified from the electron diffraction pattern (b) of FIG. 7. In addition, it can be verified from the element map image of FIG. 8 that, in the ultrafine particles in the matrix crystal grains, Ni and Ti were richer than the other portions. It is considered from the observation and analysis results that the ultrafine particles are γ' phase observed in the electron diffraction pattern.

The above-described embodiment and experimental examples have been described to help understanding of the present invention, and the present invention is not limited to the described specific configurations. For example, a part of the configuration of the embodiment can be replaced with a configuration of a common technical knowledge of a person skilled in the art. In addition, a configuration of a common technical knowledge of a person skilled in the art may be added to the configuration of the embodiment. That is, in the present invention, for a part of the configurations of the embodiment or the experimental example in the present specification, deletions, replacements with other configurations, and addition of other configurations can be made within a range not departing from the technical idea of the present invention.

The invention claimed is:

1. An alloy material consisting of:
25 at % or more and 38 at % or less of Co;
16 at % or more and 23 at % or less of Cr;
12 at % or more and 20 at % or less of Fe;
17 at % or more and 28 at % or less of Ni;
1 at % or more and 7 at % or less of Mo;
1 at % or more and 4.5 at % or less of Ti;
0.5 at % or more and 4 at % or less of Ta;
0 at % or more and 4 at % or less of Nb; and
a remainder being unavoidable impurities,
wherein a total content of Ti, Ta, and Nb is 3 at % or more and 8 at % or less.

2. The alloy material according to claim 1,
wherein the content of Ti is 2 at % or more and 4.5 at % or less.

3. An alloy product that is formed of the alloy material according to claim 1,
wherein when a secondary electron image of a cross-section of the alloy product is observed with a scanning electron microscope, a total occupancy of n phase and Laves phase precipitates having a size of 1 μm or more is 5 area % or less.

4. The alloy product according to claim 3,
wherein ultrafine particles having an average particle size of 130 nm or less are dispersed and precipitated in matrix crystal grains of the alloy product.

5. A mechanical device comprising the alloy product according to claim 3.

6. The alloy material according to claim 1,
wherein the content of Mo is 2 at % or more and 7 at % or less.

7. The alloy material according to claim 1,
wherein the content of Cr is 16 at % or more and 21 at % or less.

* * * * *